US006475963B1

(12) United States Patent
Bloch et al.

(10) Patent No.: US 6,475,963 B1
(45) Date of Patent: Nov. 5, 2002

(54) CARBOXYLATE-VINYL ESTER COPOLYMER BLEND COMPOSITIONS FOR LUBRICATING OIL FLOW IMPROVEMENT

(75) Inventors: Ricardo A. Bloch, Scotch Plains, NJ (US); David J. Martella, Princeton, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/846,469

(22) Filed: May 1, 2001

(51) Int. Cl.[7] ..... C10M 145/16
(52) U.S. Cl. ..... 508/467; 508/468; 508/591
(58) Field of Search ..... 508/467

(56) References Cited

U.S. PATENT DOCUMENTS

| | | | | | |
|---|---|---|---|---|---|
| 2,618,602 | A | | 11/1952 | Bartlett | 252/56 |
| 2,825,717 | A | | 3/1958 | Cashman et al. | 260/78.5 |
| 3,413,103 | A | | 11/1968 | Young et al. | 44/62 |
| 3,507,908 | A | | 4/1970 | Young et al. | 260/485 |
| 4,068,056 | A | | 1/1978 | Engel et al. | 526/49 |
| 4,068,058 | A | | 1/1978 | Engel et al. | 526/49 |
| 4,088,589 | A | | 5/1978 | Rossi et al. | 252/56 R |
| 4,089,794 | A | | 5/1978 | Engel et al. | 252/51.5 A |
| 4,137,185 | A | | 1/1979 | Gardiner et al. | 252/33 |
| 4,146,489 | A | | 3/1979 | Stambaugh et al. | 252/50 |
| 4,149,984 | A | | 4/1979 | Wenzel et al. | 252/51.5 A |
| 4,160,739 | A | | 7/1979 | Stambaugh et al. | 252/34 |
| 4,211,534 | A | * | 7/1980 | Feldman | 44/62 |
| 4,634,550 | A | | 1/1987 | Feldman et al. | 252/56 D |
| 4,661,121 | A | | 4/1987 | Lewtas | 44/70 |
| 4,661,122 | A | | 4/1987 | Lewtas | 44/70 |
| 4,670,130 | A | | 6/1987 | Dekraker et al. | 208/33 |
| 4,713,088 | A | | 12/1987 | Tack et al. | 44/62 |
| 4,810,260 | A | * | 3/1989 | Tack et al. | 44/62 |
| 4,826,615 | A | | 5/1989 | Rossi et al. | 252/56 R |
| 4,839,074 | A | | 6/1989 | Rossi et al. | 252/56 D |
| 4,863,486 | A | | 9/1989 | Tack et al. | 44/62 |
| 4,956,492 | A | | 9/1990 | Dekraker et al. | 560/190 |
| 4,963,279 | A | | 10/1990 | Rosental et al. | 252/56 R |
| 5,112,510 | A | | 5/1992 | Rossi | 252/56 R |
| 5,330,545 | A | | 7/1994 | Lewtas et al. | 44/395 |
| 5,744,429 | A | * | 4/1998 | Chung et al. | 508/221 |
| 5,939,365 | A | | 8/1999 | Redpath et al. | 508/467 |

FOREIGN PATENT DOCUMENTS

| | | | |
|---|---|---|---|
| GB | 1080910 | 8/1967 | C08F/15/20 |
| GB | 1469016 | 3/1977 | C10L/1/18 |
| JP | 738998/33 | 11/1982 | C10M/3/12 |
| JP | 224447/20 | 6/1996 | C10M/135/06 |
| JP | 425603/36 | 3/1998 | C10M/145/06 |
| JP | 275917/23 | 3/1999 | C10L/1/14 |

OTHER PUBLICATIONS

"Why Do Base Oils Matter?", D. McFall, Mar. 6, 2000.
"The Effect of High Quality Basestocks on PCMO Fuel Economy", National Petrochemical & Refiners Association, LW–99–126, Crosthwait et al., pp. 1–12.
"Polymers as Lubricating–Oil Viscosity Modifiers", Ver Strate et al., Polymers as Rheology Modifiers Chapter 15, pp. 256–272.
Basestocks "Struggle—Group II–Plus Wants a Piece of the Motor Oil Pie" Lubes'N'Greases, D. McFall, pp. 27–29.
"Functions of Additives (5): VI Improvers and Pour Point Depressants", Japanese Journal of Tribology, S. Takigawa, vol. 40, No. 4, 1995, pp. 321–329.
"Synthesis and Evaluation of Alkyl Fumarate—Vinyl Acetate Copolymers in Combination with Alkyl Acrylates as Flow Improvers for Borholla Crude Oil", a. Borthakur et al., J. Chem. Tech. Biotechnol. 1995, vol. 62, pp. 75–80.
"Ashless Polymeric Additives: Detergency Dispersal Characteristics", A. K. Misra et al., Journal of the Institute of Petroleum, pp. 290–298.

* cited by examiner

*Primary Examiner*—Ellen M. McAvoy

(57) ABSTRACT

Compositions for improving at least the low temperature flow properties of high viscosity index, high saturates, low sulfur lubricating oils (also known as American Petroleum Institute Group II and Group III oils). The compositions comprise a mixture of lubricating oil flow improvers (LOFIs) that are specified first and second component copolymers of unsaturated dicarboxy esters, including a first component which is a polymer or copolymer of a carboxylate containing pendent ester groups wherein the average side chain carbon number is between 11.0 and 12.4, such as dialkyl fumarate/vinyl acetate copolymer, and a second component which also is a polymer or copolymer such as dialkyl fumarate/vinyl acetate copolymer, but wherein the average side chain carbon number is between 12.7 and 15.0. Alternatively, each of the polymers or copolymers can be esterified styrene/maleic anhydride copolymer, or esterified olefin/maleic anhydride copolymer provided that each of the two components has the specified, different average side chain carbon numbers.

40 Claims, No Drawings

CARBOXYLATE-VINYL ESTER COPOLYMER BLEND COMPOSITIONS FOR LUBRICATING OIL FLOW IMPROVEMENT

BACKGROUND OF THE INVENTION

The present invention relates to additives for improving the flow properties of certain oleaginous composition, particularly lubricating oil compositions in which are used lubricating oil basestocks characterized as "Group II" and "Group III" according to the American Petroleum Institute. More particularly, the present invention relates to additives for improving at least the low temperature flow properties of lubricating oil compositions, and more particularly lubricating oil compositions that include lubricating oil flow improvers in combination with high ethylene content ethylene alpha-olefin copolymer (EAO) viscosity index improvers. Still more particularly, the present invention relates to improved lubricating oil compositions including such additives for improving the flow properties thereof. The present invention relates also to methods for improving the flow properties of oleaginous compositions, particularly engine crankcase lubricating compositions.

A wide variety of compounds for use as lubricating oil or fuel oil additives are known. These include compounds variously referred to as pour point depressants (PPD), viscosity index improver (VII) or viscosity modifier (VM) compositions, wax crystal modifiers, and the like. In particular, Cashman et al, U.S. Pat. No. 2,825,717, discloses the preparation of certain lubricating oil additives by the copolymerization of polycarboxylic acid esters with other polymerizable monomeric materials, including vinyl compounds such as vinyl acetate. The preferred unsaturated polycarboxylic acid esters therein are fumaric acid esters produced from $C_1$ through $C_{18}$ aliphatic alcohols.

Bartlett, U.S. Pat. No. 2,618,602, discloses pour point depressing and/or viscosity index improving materials obtained by polymerizing certain specified alkyl fumarate esters. In particular this patentee discloses the use of polymerized fumarate esters of $C_{12}$ to $C_{14}$ alcohols for such purposes. This patent specifically discloses that the $C_{12}$ alcohol was more effective than the $C_{14}$ alcohol, although both polymerized esters exhibited pour point depressing properties.

Rossi et al, U.S. Pat. No. 4,088,589, discloses the use of specified mixtures of lubricating oil pour point depressants which include polyesters consisting of a polymeric ester of acrylic acid or methacrylic acid and a monohydric alcohol containing from 10 to 18 carbon atoms, and/or interpolymers of a vinyl alcohol ester of a $C_2$ to $C_{18}$ alkanoic acid (e.g., vinyl acetate) and a di- ($C_6$–$C_{18}$ alkyl) fumarate as one of the components thereof for improving the viscosity index of high wax content lubricating oils which also include viscosity index improving ethylene copolymers. Also, Wyman, U.S. Pat. No. 3,250,715, discloses terpolymers of dialkyl fumarates, vinyl esters, and alkyl vinyl ethers for improving the pour point of lubricating oils, and most particularly in which the dialkyl fumarates are prepared from various $C_{10}$ through $C_{18}$ alcohols including tetradecyl alcohol alone as well as alcohol mixtures averaging from 12 to 14 carbon atoms.

There has also been disclosed in U.S. Pat. Nos. 4,713,088 and 4,863,486 (R. D. Tack et al.) the use of specific dialkyl fumarate vinyl acetate polymers and copolymers in various middle distillate fuel compositions for lowering the pour point and controlling the size of wax crystals in these fuel composition products. Most specifically, these patent applications disclose the use of such compounds in which the average number of carbon atoms in the alkyl groups in the polymer or copolymer must be from 12 to 14. In addition these additives are also disclosed as being useful in combination with the polyoxyalkylene esters, ethers, esters/ethers and mixtures thereof, as well as with various other additives. Furthermore, British Pat. No. 2,023,645 discloses, for use in treating distillate fuel oils, various three-component systems which include as a first component flow improvers having an ethylene backbone, such as various ethylene polymers including ethylene polymerized with various mono- or diesters (e.g., vinyl acetate; and $C_{13}$ fumarates), as a second component a lube oil pour depressant such as various oil soluble esters and/or higher olefin polymers (e.g., dialkyl fumarate, vinyl acetate copolymers), and as a third component various polar oil-soluble compounds (e.g., phenates, sulfonates, phosphates, and carboxylates).

It is also disclosed in U.S. Pat. Nos. 4,661,121 and 4,661,122 (K. Lewtas) that the size of wax crystals forming in fuels boiling in the range of 120° C. to 500° C. can be controlled by an additive which includes the polymers and copolymers of mono- and di-n-alkyl esters of monoethylenically unsaturated $C_4$ to $C_8$ mono- or dicarboxylic acids, in which the average number of carbon atoms in the n-alkyl groups is from 14 to 18. These patents show a preference for copolymers of di-n-alkyl fumarates and vinyl acetate, and specifically state that the fumarates can be made from single alcohols or mixtures of alcohols, and when mixtures are used they are mixed prior to esterification. Furthermore, these patents disclose the use of various ethylene unsaturated ester copolymer flow improvers as co-additives therewith, but do not specify that these additives are produced from alcohol mixtures. Finally, in U.S. Pat. No. 4,956,492, which is a divisional of U.S. Pat. No. 4,670,130 (A. R. Dekraker et al.), there is disclosed as a dewaxing aid a copolymer of dialkyl fumarate and vinyl acetate in which a large proportion of the alkyl groups are $C_{20}$ to $C_{24}$ alkyl groups.

U.S. Pat. No. 5,330,545 (K. Lewtas et al.) discloses narrow boiling or sharply fractionated middle distillate fuel compositions with improved low temperature properties by the addition of a copolymer such as dialkyl fumarate-vinyl acetate. The copolymers are directed to those having specifically limited branching characteristics and limited amounts of ester monomers having greater than 20 carbon atoms and fewer than 12 carbon atoms. Furthermore, use of copolymer mixtures as taught in the prior art (GB 1,469,016) is specifically discouraged (column 2, lines 41–43) for the middle distillate fuels of interest.

GB 1,469,016 discloses a combination of pour point depressants for use in middle distillate, high end point fuels. The additives are based on an ethylene copolymer such as ethylene vinyl acetate and a polymer that is a polymer of an olefin or unsaturated dicarboxylic acid ester, such as dialkyl fumarate-vinyl acetate. Neither ethylene alphaolefin viscosity index improvers nor mixed dialkyl fumarate-vinyl acetate copolymers having controlled structures are suggested.

GB 1,080,910 discloses light oil additives of fumarate-vinyl acetate copolymer pour point depressants in combination with fumarate vinyl acetate copolymer viscosity index improvers; ethylene alphaolefin copolymer viscosity index improvers are not disclosed. Dual pour point depressants in combination with a viscosity index improver are not disclosed. The average side-chain carbon number for the reference pour point depressant is 8.8 to 10.6 and for the viscosity index improver, 7.6 to 8.6. The products for which the reference combination of additives is intended do not include high viscosity index lubricating oil basestocks having high saturates and low sulfur content.

Four Romanian patents disclose work with various additive combinations for use in diesel fuel, and "medium" and crude oils. RO 67487 discloses an additive of vinyl acetate-fumarate esters in a toluene-diesel oil mixture for use with paraffinic crude oils and heavy petroleum products. The fumarate esters used to prepare the vinyl acetate copolymers consist of a mixture of $C_{18}$, $C_{20}$, $C_{22}$ and $C_{34}$ esters. Consequently, all of the copolymers are distinguished from the present invention. RO 111108 discloses low temperature additives for use in medium oils based on a $C_{12}$ or $C_{14}$ fumarate vinyl acetate copolymer; or mixed copolymers based on $C_8$ and $C_{16}$ that provide an average of $C_{12}$ or $C_{14}$. RO 113057 discloses an additive for crude oil that includes toluene or a toluene-oil mixture in combination with mixed high carbon number side chain fumarate-vinylacetate copolymers, e.g., $C_{16}$ plus $C_{18}$. RO 114338 discloses a two component additive for use in diesel fuels. One of the components is a $C_{14}$ maleate-vinyl acetate copolymer and the other is a maleate ($C_{12}$) or fumarate ($C_{11}$)-styrene copolymer. The component having the higher carbon number alkyl side chain is claimed to be present at a higher concentration, limited to a ratio of 10:1. Furthermore, it is required that at least one of the copolymers be a styrene-containing copolymer.

An article in the Journal of the Institute of Petroleum entitled "Ashless Polymeric Additives; Detergency Dispersal Characteristics", A. K. Misra, et al., Vol. 59, No. 570 (November, 1973) discloses various polymers, copolymers and mixtures, including fumarate-vinyl acetate copolymers. Single carbon number fumarates were used e.g., $C_2$, $C_8$, $C_{10}$, $C_{12}$ and $C_{16}$ and the copolymers were typically based on a mixture of three and more monomers. The authors report that the (co)polymers can also display pour point depressing and viscosity index improving characteristics in addition to detergency and dispersancy. In particularly noteworthy remarks the authors acknowledge that others "reported in the literature that synergistic effect depends on the relative concentration of the component additives present in the combination. Similar effects have also been observed in cases of developed polymers and metallic detergent/dispersant combinations, where changing the concentration of either of the two has reversed, in some cases, their overall effect (synergism to antagonism). Development of synergistic formulations containing different types of additives is actually a trial and error method, as the overall effect of the formulation very much depends on the concentration and structure of the additives, as well as on the nature of the oil." (Id., 296). The invention disclosed herein lends support to this observation, particularly in view of the improvement effected by the dual additive in a complex mixture including a viscosity index improver and a specific lubricating oil class.

The influence of the base oil on the performance of the additive is echoed in two additional articles in this field while also describing the use of fumarate vinyl-acetate copolymers as oil additives. In the Japanese Journal of Tribology, Volume 40, Number 4, 1995, 321–329, "Functions of Additives (5): VI Improvers and Pour Point Depressants", S. Takigawa observes that, with regard to the structure of pour point depressants and their effect, "In recent years base oil with a high viscosity and large i-paraffin content started to be used in engine oils. Therefore, the problem of developing PPD in the future emerges." (Id., 328) The present invention is just such a response to that need. Similarly, in J. Chem. Tech. Biotechnol. 1995, 62, 75–80, "Synthesis and Evaluation of Alkyl Fumarate-Vinyl Acetate Copolymers in Combination with Alkyl Acrylates as Flow Improvers for Borholla Crude Oil", A. Borhakur, et al. specifically note that pour point depressant/flow improvers/wax crystal modifiers for residual fuel oils and crude oils "tend to be specific to crude oils." (Id., 75) The authors evaluated the effect of the average carbon number of the alkyl group of the fumarate on the Theological properties of the crude oil, Table 5 (Id., 78). While an effect was observed, the authors evaluated only high average alkyl carbon number compounds ($C_{16.0}$ to $C_{21.1}$) and concluded that a mixture of behenyl and cetyl fumarate in the ratio of 2:1, average carbon number 19.2, was best. Furthermore, the referenced study did not appreciate the more complex relationship, treated in the present invention, wherein the average carbon number of each of two dialkyl fumarate-vinyl acetate copolymers is controlled in order to obtain improved performance.

While these various types of additive compositions have met with various degrees of success in the particular environments in which they are employed, it has been observed that various lubricating oil compositions, such as those containing certain viscosity index improving additives, such as high ethylene-containing copolymers of ethylene and propylene, as well as those lubricating oil compositions containing lubricating oil flow improvers, nevertheless experience difficulty in passing low temperature performance tests designed to measure, e.g., the low temperature pumpability of crankcase lubricating oils. The difficulties encountered are further exacerbated by the use in such compositions of certain basestocks characterized as Group II or Group III under the system of classification used by the American Petroleum Institute according to the level of saturates, sulfur content and viscosity index (see, for example, "Basestock Struggle," Lubes'N'Greases, 5 (3), 26 (1999).

SUMMARY OF THE INVENTION

An additive composition for improving at least the low temperature flow properties of a lubricating oil composition comprising at least one lubricating oil basestock selected from the group consisting of lubricating oils of greater than or equal to 90 wt. % saturates and less than or equal to 0.03 wt. % sulfur and a viscosity index in the range of greater than or equal to 80 and equal to or less than 200, and at least one viscosity index improver selected from the group consisting of copolymers of ethylene and at least one $C_3$ to about $C_{18}$ alphaolefin, wherein the ethylene content of said ethylene containing copolymer is greater than about 30 wt. % to about 85 wt. %, said additive composition comprising a mixture of:

(A) first added lubricating oil flow improver component containing pendent ester groups having repeating methylene units derived from a mixture of alcohols present within the structure of said pendant ester groups, comprising a copolymer of (i) a first monomer of an ester of an unsaturated dicarboxylic acid or its corresponding anhydride having the formula:

(I)

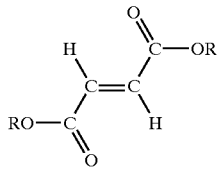

wherein R is selected from the group consisting of from about $C_6$ to about $C_{24}$ alkyl group provided that the average side chain carbon number is between 11.0 and 12.4 and (ii) a second monomer selected from the group consisting of (a) vinyl ester represented by the formula:

(II)

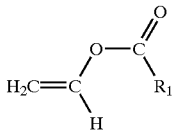

wherein $R_1$ comprises an alkyl group containing from 1 to about 18 carbon atoms, (b) about $C_6$ to about $C_{46}$ straight or branched chain alpha-monoolefin, and (c) styrene; or a polymer or copolymer of unsaturated monoester represented by the formula:

(IV)

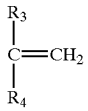

wherein $R_3$ is hydrogen or a $C_1$ to $C_5$ alkyl group; and $R_4$ is a $COOR_5$ group wherein $R_5$ is a $C_1$ to $C_{20}$ alkyl, with the proviso that the average number of carbon atoms in the groups constituting $R_5$ in the polymer or copolymer is between 11.0 and 12.4, and (B) second added lubricating oil flow improver component containing pendent ester groups having repeating methylene units derived from a mixture of alcohols present within the structure of said pendant ester groups, comprising a copolymer of (i) a first monomer of an ester of an unsaturated dicarboxylic acid or its corresponding anhydride having the formula:

(III)

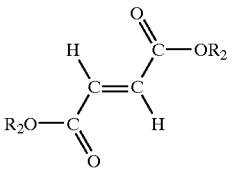

wherein $R_2$ is selected from the group consisting of from about $C_6$ to about $C_{24}$ alkyl group provided that the average side chain carbon number is between 12.7 and 15.0 and (ii) a second monomer selected from the group consisting of said second monomers set forth in (A) (ii), provided however, that when the second monomer corresponds to formula (IV) then the average number of carbon atoms in the groups constituting $R_5$ in the polymer or copolymer is between 12.7 and 15.0; and wherein the weight ratio of said first component to said second component in said composition is from about 95:5 to about 40:60.

Indeed, it has been discovered that the use of this specific combination of components as an additive provides unexpected improvement in at least the low temperature viscosity performance of lubricating oil compositions that results in properties superior to the additive effect obtained by using either of these components alone. This response permits the formulation of useful lubricating oil compositions that employ high ethylene content olefinic copolymer viscosity modifying additives in combination with basestocks having high saturate and low sulfur content as well as a high viscosity index. In a preferred embodiment, the dual additive composition of the present invention is employed in combination with a viscosity index improving amount of an ethylene-propylene copolymer viscosity modifier (or viscosity index improver).

In accordance with another embodiment of the present invention, the dual additive composition is prepared in concentrate form for convenient use by formulators and in still another embodiment the dual additive combination of components is employed in lubricating oil compositions having improved flow properties.

DETAILED DESCRIPTION

The complexity of balancing the low-temperature Theological response of lubricating oils has been compounded in recent years by the demand of regulators and automobile manufacturers for motor oils that provide better fuel economy and lower emissions. In an effort to improve fuel economy, lubricating oil refiners have resorted to producing basestocks with both low viscosity and low volatility. Low viscosity basestocks have the potential to improve fuel economy by reducing friction in the engine. Lower emissions require basestocks with lower volatility. In order to achieve the combination of low viscosity and low volatility, refiners remove aromatic and naphthenic molecules because, at a given viscosity, they have higher volatility than paraffins or isoparaffins. By removing aromatics and naphthenics components having a low viscosity index, the resulting basestocks have a high viscosity index. However, since n-paraffins have high melting points, they must be reduced in order to meet pour point requirements. Normal paraffins are removed by a variety of processes including, for example, solvent dewaxing, catalytic dewaxing, hydroisomerization, raffinate hydroconversion, as well as other proprietary processes. The result of such treatment is a basestock with high isoparaffin content. Although such basestocks have the potential to improve fuel economy and lower emissions, their response to the standard lube oil flow improvers (LOFIs) is poor. This unresponsiveness of the traditional LOFIs is further exacerbated when the basestock is formulated with viscosity index improvers based on high-ethylene containing ethylene alphaolefin copolymers.

The additives of the present invention comprise a mixture of specified first and second component unsaturated dicarboxy esters copolymers (also sometimes referred to as interpolymers). The first critical component of this mixture is at least one copolymer or interpolymer of an (i) unsaturated dicarboxy ester having the formula:

(I)

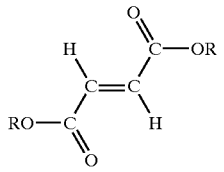

wherein R is selected from the group consisting of from about $C_6$ to about $C_{24}$ alkyl group provided that the average side chain carbon number is between 11.0 and 12.4 and, in a preferred embodiment (ii) vinyl ester represented by the formula:

(II)

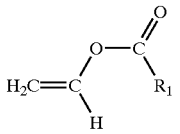

wherein $R_1$ comprises an alkyl group containing from 1 to about 18 carbon atoms. The production of these diester copolymers includes an esterification reaction between unsaturated dicarboxylic acids or their corresponding anhydrides, as well as the polymerization of the esterified monomers. Such reactions are well known in the art; for example, Cashman et al, U.S. Pat. No. 2,825,717, specifically discloses the reaction beginning at column 2, line 35, which disclosure is incorporated herein by reference to the extent permitted. The copolymerization reaction of the diester monomers of formula (I), with a monomer of formula (II), preferably vinyl acetate, is preferably carried out in the presence of free radical initiator, such as a peroxide catalyst.

The synergistic combination of the present invention includes, along with the specified first component, at least one second added component comprising a dicarboxy ester copolymer or interpolymer containing pendent ester groups having repeating methylene units derived from a mixture of alcohols present within the structure of said pendant ester groups, comprising a copolymer of (i) unsaturated dicarboxy ester having the formula:

(III)

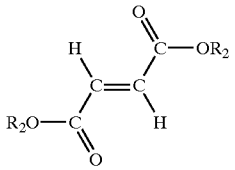

wherein $R_2$ is selected from the group consisting of from about $C_6$ to about $C_{24}$ alkyl group provided that the average side chain carbon number is between 12.7 and 15.0 and, also in a preferred embodiment (ii) vinyl ester represented by the formula II; and the weight ratio of said first component to said second component in said composition varying from about 95:5 to about 40:60. Both the first and second copolymer components are conveniently referred to as lubricating oil flow improvers or LOFIs. Alternative chemical classes of LOFIs having the same average side chain carbon numbers in each of the components that are useful in the present invention are also described hereinbelow.

For purposes of the present invention the following terms are defined:

The term "about" when used as a modifier for, or in conjunction with, the size of a variable is intended to convey that the numbers and ranges disclosed are flexible and that practice of the present invention by those skilled in the art using temperatures, concentrations, amounts, contents, carbon numbers, properties such as molecular weight and viscosity, etc., that are outside of the range or different from a single value will achieve the desired result, namely compositions for improving the low temperature flow properties of high viscosity index, high saturates, low sulfur lubricating oils, particularly those in which there is present an ethylene alphaolefin viscosity index improver. If not otherwise stated, the term "about" typically includes a range of ±10% for the value that it modifies. Furthermore, where a range of values is expressed, it is to be understood, unless otherwise expressed, that the present invention contemplates the use of other ranges that are subsumed within the broadest range.

"Polymer" includes copolymer unless otherwise specifically stated to be limited to a polymer derived solely from the polymerization of a single monomer. Furthermore, with reference to ethylene alphaolefin copolymers, it is also understood that such copolymers can optionally contain a minor amount (for example, greater than zero, but less than 10% by weight) of a nonconjugated polyene, in which case the copolymer is sometimes referred to as a terpolymer. For convenience, the term "copolymer" generally will be used throughout, but with reference to ethylene alphaolefin polymers it is to be understood to include both copolymers and terpolymers of ethylene with at least one other alpha-olefin.

The general term "lubricating oil flow improver" (LOFI) covers all of those additives which modify the size, number, and growth of wax crystals in lubricating (or lube for short) oils in such a way as to impart improved low temperature handling, pumpability, and/or vehicle operability as measured by such tests as pour point, Mini-Rotary Viscometer (MRV), and Scanning Brookfield Viscometer, hereinafter defined. The majority of lubricating oil flow improvers are polymers or copolymers, or contain polymers or copolymers. These polymers are generally of two types, either side chain or backbone (mixtures of these are also useful). For purposes of the present invention the LOFIs employed are of the side chain type.

"Thickening Efficiency" (T.E.) is defined as the ratio of (a) the weight percent of a polyisobutylene oil solution (available commercially as "Infineum V8512", Infineum USA L.P., formerly designated "Paratone N" from Exxon Chemical Co.), having a Staudinger Molecular Weight of 20,000, required to thicken a solvent-extracted neutral mineral lubricating oil, having an unmodified or initial viscosity of 150 SUS at 37.8° C., a viscosity index of 105 and an ASTM pour point of 0° F. (−17.8° C.), (commonly referred to as Solvent 150 Neutral oil) to a viscosity of 12.4 centistokes at 98.9° C., to (b) the weight percent of a test copolymer required to thicken the same oil to the same viscosity at the same temperature. T.E. is related to weight average or viscosity average molecular weight and is a convenient, useful measurement for formulation of lubricating oils of various grades.

"Mn" or number average molecular weight and "Mw" or weight average molecular weight are defined by the following equations:

$$Mn = \frac{\sum N_i M_i}{\sum N_i} \qquad Mw = \frac{\sum N_i M_i^2}{\sum N_i M_i}$$

wherein $N_i$ is the number of molecules of molecular weight $M_i$.

"Viscosity Index (V.I.)" is the ability of a lubricating oil to accommodate increases in temperature with a minimum decrease in viscosity; the greater this ability, the higher the V.I. numerical value. In the field of lubrication and lubricating compositions, V.I. is typically measured according to ASTM D2270.

"Shear Stability Index (SSI)" measures the mechanical stability of polymers used as V.I. improvers and subjected to high strain rates, particularly those used in crankcase lubricating compositions. The diesel fuel injector test is commonly used to measure performance, ASTM D3945, equivalent to DIN 51382. To determine SSI, the polymer under test is dissolved in a suitable base oil (for example, solvent extracted 150 neutral) to a relative viscosity of 2 to 3 at 100° C. The oil solution is then circulated through a diesel fuel injector, for a total of thirty passes. The SSI is calculated from the initial kinematic viscosity ($V_i$), the final kinematic viscosity ($V_f$), and the base oil viscosity ($V_b$), each at 100° C., according to the equation:

$$SSI(\%)=100\times(V_i-V_f)/(V_i-V_b).$$

A reference sample (as required by the DIN method) is used to calibrate the test. The SSI value is indicative of the resistance of a polymer to molecular weight degradation by shearing forces. The higher the SSI the less stable the polymer, i.e., the more susceptible it is to molecular weight degradation.

"Mini-Rotary Viscometer (MRV)" performance is measured at low temperatures and is determined using a technique described in ASTM-D3829. MRV TP-1 is determined using the test method described in ASTM-D4684. This is essentially the same as the MRV test except that a slow cooling cycle is used. The cycle is defined in SAE Paper No. 850443, K. O. Henderson et al. MRV TP-1 is determined at a temperature that depends on the viscosity grade of the oil, e.g., −35° C. for an SAE 5 W oil, and is used by the SAE (J300 Specification) for determining the low temperature pumpability of a crankcase oil. The sample is subjected to a temperature profile in accordance with the procedure. During the test, the temperature is gradually lowered to the test temperature, and then at that temperature the yield stress (YS) is measured in pascals, and the apparent viscosity (VIS) is measured in pascal seconds, or centipoise (since the oil is present as a two-phase system an apparent viscosity is determined rather than a true viscosity). For example, in accordance with SAE requirements for 15 W-40 oils, the target values of less than 35 pascals (YS) and not greater than 60 pascal seconds (VIS) are considered acceptable in order to provide a pumpable composition at −25° C., i.e., to maintain fluidity.

"Cold Cranking Simulator (CCS)" performance is another test conducted at low temperature and high shear and is determined using the procedure described in ASTM D5293; viscosity results are reported in centipoise. This test is related to the resistance of lubricating oil to cold engine starting. The higher the CCS value, the greater the oil's resistance to cold engine starting.

"Pour point" measures the ability of an oil composition to flow as the temperature is lowered; performance is tested according to the procedure described in ASTM D97 and the results are reported in degrees centigrade. It, too, is a measure of an oil's low temperature performance. Although pour point is not important for engine pumpability, it continues to be required by the industry as a measure of oil dispensability from a container at low temperature. The typical pour point specification is −36° C. for a SAE 5 W viscosity grade oil and −30° C. for a SAE 10 W viscosity grade oil.

"Scanning Brookfield Viscometer" test (ASTM D 5133) predicts potential engine oil pumpability due to air binding related to oil gelation. The typical Scanning Brookfield Gel Index specification is less than 12.0 and in one case less than 8.5.

The first and second LOFI components are characterized by low to moderate molecular weights. In particular values of Mn, as determined by vapor phase osmometry or membrane osmometry, of not greater than about 60,000, and typically ranging from about 1,500 to about 50,000, and preferably from about 2,500 to about 40,000; for example from about 4,000 to about 60,000. Alternatively, molecular weight can conveniently be suggested by the specific viscosity exhibited by such copolymers. Accordingly, such specific viscosities will typically range from about 0.11 to about 2.2, preferably from about 0.2 to about 0.9, and most preferably from about 0.2 to about 0.7. Specific viscosities are determined in accordance with the following equation:

$$\text{Specific Viscosity}=(K_{vis}\text{ of Solution}/K_{vis}\text{ of Solvent})-1$$

wherein "$K_{vis}$ of Solution" is the kinematic viscosity at 104° F. (40° C.) of a 2.0 mass/volume percent solution of the polymer (active ingredient or "a.i." basis) in toluene or commercially available mixed xylenes as the solvent, using Ubbelohde-type viscometers with a viscometer constant of about 0.003 cSt/second; and "$K_{vis}$ of Solvent" is the corresponding kinematic viscosity of the solvent alone at the same temperature.

Sidechain-type polymers are the predominant variety used as LOFIs, and such polymers have methylene segments as the side chains, preferably as straight side chains. While not wishing to be bound by theory, it is believed that these polymers have various lengths of methylene segments randomly distributed in the sidechains of the polymer that associate or co-crystallize with the wax crystals inhibiting further crystal growth due to branches and non-crystallizable segments in the polymer. Such side chains have been found to be particularly effective in treating lubricating oil basestocks containing isoparaffins as well as n-paraffins.

The lubricating oil flow improvers of the present invention generally comprise long chain flow improving polymers or interpolymers that contain pendent ester groups derived from a mixture of alcohols whereby the alcohol residue can be characterized as repeating methylene units, and which are oil soluble, or dispersible, polymeric compositions that generally have low to moderate number average molecular weights, as recited above.

The lubricating oil flow improvers of the present invention include interpolymers; preferably copolymers of certain unsaturated dicarboxy esters with certain specified polymerizable monomeric compounds, namely, vinyl esters, alphaolefins or styrene.

Suitable ethylenically unsaturated dicarboxylic acids or their anhydrides, which are eventually esterified, have the carboxyl or anhydride groups located on vicinal carbons, and have 4 to 10 carbons in the unesterified monomer molecule. Suitable dicarboxylic acids or anhydrides thus include fumaric acid, maleic anhydride, mesaconic acid, citraconic acid and anhydride, and itaconic acid and its anhydride. The particular dicarboxylic acid or anhydride monomer that is preferred will depend on the identity of its comonomer. Thus, when the comonomer is a vinyl ester, the preferred dicarboxylic acid is fumaric acid. When the comonomer is an alphaolefin or styrene, the preferred dicarboxylic monomer is maleic anhydride. Furthermore, whether it is preferable to esterify the dicarboxylic acid or anhydride monomer first and then copolymerize, or to first copolymerize the free acid or anhydride monomer and then esterify, depends on the particular identity of the dicarboxylic monomer and its comonomer. Thus, for example, it is conventional to first esterify the fumaric acid monomer or any other dicarboxylic monomer, prior to copolymerization with a vinyl ester. In contrast, it is also conventional to polymerize maleic anhydride with styrene or the alphaolefins, and to then esterify.

As indicated above, the dicarboxylic monomer can be copolymerized with a variety of different comonomers; the first of these is a vinyl ester comonomer defined by formula (II):

(II)

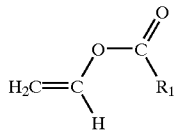

wherein which $R_1$ is an alkyl group containing from about 1 to 18 carbon atoms, preferably from about 1 to 6 carbon atoms, and most preferably 1 carbon atom, whereby the preferred ester monomer of formula (II) is vinyl acetate.

The preferred copolymers or interpolymers of lubricating oil flow improvers are dialkyl fumarate/vinyl acetate copolymers having average side chain carbon number characteristics as described above.

The mole ratio of the vinyl ester monomer, formula (II), to the mole ratio of the unsaturated dicarboxy monomer, formula (I), in the polymerization reaction mixture can vary typically from about 3.0:1 to 0.33:1, preferably from about 1.5:1 to 0.7:1, and most preferably from about 1.1:1 to 0.8:1. These copolymers of the present invention can be prepared by conventional free radical polymerization techniques, for example, starting with a mixture of all of the constituent monomers which mixture is essentially free of homopolymer or copolymer. Conventional free radical polymerization catalysts can be used, such as azobis-(isobutyronitrile), tert-butyl hydroperoxide, and benzoyl peroxide. Such polymerizations can be conducted neat or in bulk (i.e., in the absence of a solvent) or in the substantial absence of solvent. Polymerization of the ester monomers is preferably carried out in an inert hydrocarbon solvent, such as hexane or heptane, or low viscosity lubricating oils. Polymerization is carried out in an oxygen-free reactor and the desired atmosphere can be maintained by utilizing a nitrogen atmosphere as is known in the art. Temperatures of about 65° C. to about 150° C., depending on the choice of initiator, can be used. Polymerization is carried out at either atmospheric or superatmospheric pressure and on either a batch or a continuous basis. Polymerization can be stopped using known techniques when the preferred degree of polymerization (or copolymer molecular weight) is reached, such as adding inhibitors to the reaction mixture, or can be allowed to go to completion. Where a solvent other than a lubricating oil is used, it is separated from the resulting LOFI copolymers by standard process methods known in the art before the LOFIs are ready for dissolution or dispersion to form a concentrate or are included in a lubricating oil formulation.

The second type of comonomer employed for copolymerization with the unsaturated dicarboxylic monomer is an alpha-monoolefin. Straight chain alphaolefins are preferred over branched chain alphaolefins. Moreover, if branching occurs, it is preferred that it occur at the beta-carbon, and that such branching contain not more than about 5, and preferably not more than about 2, carbons. Suitable alphaolefins typically contain between about 6 and 46, e.g., between about 10 and 22, and preferably about 18 carbon atoms per molecule. Mixtures of olefins may be used, e.g., a $C_{10}$–$C_{24}$ mixture. Representative alphaolefins include 1-hexene, 1-heptene, 1-nonene, 1-decene, 1-hexadecene, 1-octadecene, 1-eicosene, 1-heneicosene, 1-docosene, 1-tricontene, 1-tetracontene, 2-methyloctadecene, 2-ethyleicosene, and mixtures thereof. The mole ratio of alphaolefin to unsaturated dicarboxylic monomer employed in the reaction mixture will typically range from about 1.2:1 to about 0.8:1, preferably from about 1.1:1 to about 0.9:1, and most preferably about 1:1. The preferred copolymer of this class is a copolymer of 1-octadecene and maleic anhydride subsequently esterified with the alcohols in the manner described hereinafter.

The third preferred comonomer for copolymerization with the unsaturated dicarboxylic monomer is styrene. In forming this preferred unesterified intermediate polymer, the molar ratio of styrene to unsaturated dicarboxylic-containing monomer (e.g., maleic anhydride) can typically vary from about 3:1 to about 1:1; preferably from about 2:1, to about 1:1, and most preferably from about 1.5:1 to about 1:1. Most preferably, equal molar amounts of styrene and unsaturated carboxyl-containing monomer (e.g., maleic anhydride) are employed. In addition, minor amounts of other miscellaneous interpolymerizable comonomers can be included in the reaction mixture. By minor amount is typically meant less than about 1, preferably less than about 0.3 moles of miscellaneous monomers per mole of carboxyl-containing monomer. Similar considerations, vis-a-vis miscellaneous monomers, apply with respect to use of the alphaolefins as a comonomer for interpolymerization with the dicarboxylic monomer.

Various methods of polymerizing styrene or the alphaolefins and the dicarboxylic-containing monomers are known in the art and need not be discussed in detail herein. Such methods include neat and bulk polymerization techniques. The polymerization reaction for use of either the styrene or alphaolefin comonomers with the dicarboxylic monomer is typically conducted to produce an unesterified interpolymer having a number average molecular weight of less than about 25,000, preferably less than about 15,000, as determined by membrane osmometry. Upon esterification, such molecular weights will be as described generally above as well as the corresponding specific viscosities.

The resulting interpolymer is then esterified with an alcohol mixture of the type described below with respect to esterification of the dicarboxylic monomer. The esterification reaction can be accomplished simply by heating the dicarboxylic-containing polymer and the alcohol mixture under conditions typical for effecting esterification. Such conditions usually include, for example, a temperature of at least about 80° C., preferably from about 100° C. to about 150° C., provided that the temperature is below the decomposition point of the reaction mixture, and the water of esterification is removed as the reaction proceeds. Such conditions may optionally include the use of an excess of the alcohol reactant so as to facilitate esterification, the use of a solvent or diluent such as mineral oil, toluene, benzene, xylene or the like, and the use of an esterification catalyst such as toluene sulfonic acid, sulfuric acid, phosphoric acid, or the like. These conditions and variations thereof are well known in the art.

Another class of lubricating oil flow improvers useful in accordance with the present invention comprises the polymers and copolymers of unsaturated monoesters, preferably polymers of long side chain unsaturated monoesters, and copolymers of long and short side chain unsaturated monoesters. The polymers and copolymers of this class of LOFIs are intended to be used as mixtures within this class or with the other LOFIs as described above provided that the average side chain carbon number derived from the alcohols employed satisfy the values for each of the first and second components of the dual additive composition. The unsaturated esters are generally acrylate or 2-alkylacrylate monoesters represented by the formula (IV):

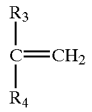

(IV)

wherein $R_3$ is hydrogen or a $C_1$ to $C_5$ alkyl group; and $R_4$ is a $COOR_5$ group wherein $R_5$ is a $C_1$ to $C_{20}$, preferably a $C_{10}$ to $C_{18}$ alkyl group. A 2-alkylacrylate is one wherein $R_3$ is alkyl. The hydrocarbyl groups constituting $R_5$ represent the hydrocarbyl residues of mixtures of alcohols from which the same are prepared, which alcohols are preferably saturated, although some degree of unsaturation is permissible when mixtures of alcohols are employed, e.g., less than about 2 mole % of the alcohols in the mixture can be unsaturated. Straight chain or lightly branched alcohols are preferred over highly branched alcohols. The mixture of alcohols employed are those containing from $C_1$ to about $C_{20}$ carbons which can be employed in such proportions that the average number of carbons in the alcohol residue of the monomer molecule is preferably between either (A) 11.0 and 12.4 or (B) between 12.7 and 15.0. Representative acrylate, and $C_1$ to $C_5$ 2-alkylacrylate monomers suitable for use in preparing the ester polymers and copolymers of Formula (IV), subject to the above carbon number average restrictions, include methyl acrylate, propyl methacrylate, propyl ethacrylate, octyl propacrylate, decyl butacrylate, dodecyl pentacrylate, hexyl methacrylate, octyl ethacrylate, decyl methacrylate, dodecyl methacrylate, tetradecyl methacrylate, hexadecyl methacrylate, octadecyl methacrylate, tridecyl acrylate, tetradecyl methacrylate, pentadecyl acrylate, hexadecyl acrylate, and octadecyl acrylate. Most preferred acrylates or 2-alkyl acrylates are those containing $C_{12}$ to $C_{18}$ alkyl esters having a carbon number average in the mixture for the alkyl (alcohol residue) portion of the ester as described in (A) and (B) above.

The long chain aliphatic esters are those described in Formula (IV) wherein $R_5$ may be prepared from mixed aliphatic alcohols containing from 8 to 20 carbon atoms per molecule in such proportions that the average number of carbons in the alcohol residue of the monomer molecule is preferably between either (A) 11.0 and 12.4 or (B) between 12.7 and 15.0 as described above; saturated aliphatic alcohols are preferred. Short chain unsaturated esters, having the above-noted Formula (IV), but wherein $R_5$ has less than 10 carbons, preferably 1 to 5 carbons, in amounts of 5 to 50 molar percent, preferably 10 to 20 molar percent, based on the total polymer, can be copolymerized with the long chain unsaturated esters provided that the average carbon number limitations of (A) and (B) are met. Preferably, all the alkyl esters in a given polymer will have the same acid moiety, e.g., the mixture of esters will be a mixture of acrylates or 2-alkylacrylates (e.g., methacrylates). The polymers or interpolymers of Formula (IV) are characterized by number average molecular weights and specific viscosities as described above.

The polymers and interpolymers of Formula (IV) can be prepared by conventional free radical polymerization techniques, starting with a mixture of all of the constituent monomers that is essentially free of polymer. Thus, the polymers are generally random copolymers rather than graft or block interpolymers. Conventional free radical polymerization catalysts, such as azobis (isobutyronitrile), tert butyl hydroperoxide, and benzoyl peroxide, can be used. Such polymerization techniques again include neat and bulk polymerization techniques. Polymerization of the ester monomers is preferably carried out in an inert hydrocarbon solvent, such as hexane or heptane or low viscosity lubricating oil. Polymerization is carried out in an oxygen-free reactor. The desired atmosphere can be maintained by carrying out the polymerization in a nitrogen atmosphere as is known in the art. Temperatures of about 65° C. to about 120° C., depending on the choice of initiator, can be used. Polymerization is carried out at either atmospheric or superatmospheric pressure and on either a batch or continuous basis. Polymerization can be stopped when the desired degree of polymerization is reached by known techniques, such as adding inhibitors to the reaction mixture, or can be allowed to go to completion.

The nature of the alcohols used for esterification, for example of the dicarboxylic acid or anhydride, whether prior or subsequent to copolymerization, is selected such that the average side chain carbon number of each of the dual LOFI additive components is as set forth below. Moreover, while it is preferred to achieve complete esterification of all of the carboxyl groups of the dicarboxylic monomer, it is permissible to achieve only partial esterification, but typically not less than about 70 mole %, and preferably not less than about 80 mole % of the carboxyl groups available to be esterified. Accordingly, esterification is typically conducted with mixtures of alcohols, which alcohols can be slightly branched, but preferably are straight chain alkyl. Thus, the alcohols used for esterification are selected from the $C_1$ to $C_{24}$ aliphatic alcohols, preferably the $C_4$ to $C_{24}$ aliphatic alcohols, and more preferably the $C_6$ to $C_{24}$ aliphatic alcohols. Primary alcohols are preferred over secondary and tertiary alcohols, and the alcohols are preferably saturated, although some degree of unsaturation (i.e., less than about 2 mole %) is permissible in various alcohol mixtures. Straight and lightly branched chain alcohols are preferred over highly branched alcohols. The alcohols particularly selected for esterification should include sufficient hydrocarbon (i.e., carbon chain length) to insure oil solubility or dispersibility in the lubricating oils of the present invention. Thus mixtures of alcohols in the $C_4$ to $C_{26}$ average carbon number range are preferred, most particularly in the $C_6$ to $C_{24}$ range. Alternatively, the alcohols selected can be based on single carbon number alcohols, provided that the resulting side-chain carbon numbers of the components are in accordance with the values specified below. However, the alcohols employed to produce the first and second components of the LOFI differ in a very specific and significant manner. One of the LOFI copolymers, herein referred to for convenience as the first component, has an average side-chain carbon number between 11.0 and 12.4; more preferably between 11.5 and 12.2. Average side chain carbon number is determined either by gas chromatographic analysis of the mixture of alcohols used in the esterification to produce the monomer or by $^{13}$C-NMR of the polymer. The first component copolymer can also be referred to as the "low melting point" component. In contrast, the second LOFI component (alternatively, the "high melting point" copolymer component) will have an average side-chain carbon number of between 12.7 to 15.0, more preferably between 12.8 and 14.0. Representative examples of suitable alcohols thus include n-butanol, sec-butanol, isobutanol, n-pentanol, neopentanol, n-hexanol, octanol, isooctanol, decanol, n-dodecanol, n-tricosanol, n-tetracosanol, n-tridecanol, n-tetradecanol, n-hexadecanol, n-octadecanol, and mixtures thereof.

Preferred lubricating oil compositions of the present invention include a viscosity index improver that is combined with the dual additive LOFI composition in a lube oil formulation. Thus, while the dual additive composition of the present invention need not be sold in admixture with a viscosity index improver, the former will normally exert its desired effect in the presence of the latter. These oil-soluble hydrocarbon polymeric viscosity index (V.I.) improver additives contemplated to be compounded, mixed or blended into the lubricating oil composition or formulation in accordance with this invention are generally high molecular weight hydrocarbon polymers. In the present invention, the V.I. improvers are of a specific type and may also be derivatized in order to achieve other properties or functions, such as the addition of dispersancy properties. Such multifunctional V.I. improvers are also well known in the art. The oil soluble V.I. polymers will generally have number average molecular weights of from about 20,000 to about 500,000, preferably from about 25,000 to about 400,000, more preferably from about 30,000 to about 300,000 as determined by gel permeation chromatography or membrane osmometry.

Examples of suitable hydrocarbon polymers include copolymers of ethylene copolymerized with at least one additional alphaolefin monomer having from 3 to about 30, preferably from about 3 to about 8 carbon atoms and which may be straight or branched; optionally, a low concentration, e.g., less than about 10 wt. %, of a nonconjugated diene may be present. Particularly preferred copolymers are those comprising ethylene and propylene. Other ethylene copolymers known in the art and suitable as viscosity index improvers in the present invention include those described as tapered or block copolymers (including terpolymers, tetrapolymers, etc.) as well as those that have controlled compositional homogeneity and/or heterogeneity within and among copolymer chains. (See, for example, "Polymers as Lubricating Oil Viscosity Modifiers", G. VerStrate, M. J. Struglinski, Chapter 15, in "Polymers as Rheology Modifiers", D. N. Schulz and J. E. Glass, editors, American Chemical Society, Washington, D.C., 1991; incorporated herein by reference to the extent permitted).

The dual additive LOFI composition is particularly effective when there is present in the lubricating oil formulation V.I. copolymers of ethylene and one or more $C_3$ to $C_8$ alphaolefin, such copolymer comprising greater than about 30 wt. % ethylene, preferably greater than about 35 wt. % of ethylene, more preferably greater than about 39 wt. % ethylene. The maximum amount of ethylene that usefully can be present in the V.I. copolymer is not critical provided that the copolymer can still function as a viscosity index improver in the lubricating oil formulation; for example, an amount such that the copolymer remains soluble in the oil composition, e.g., generally up to about 85 wt. %; typically up to about 75 wt. % ethylene. Such copolymers can be substantially amorphous, that is, such copolymers are free of crystallinity or have a level of crystallinity that is barely detectable by X-ray or differential scanning calorimetry (e.g., the level is equal to or slightly greater than the experimental error associated with the test procedure). Copolymers of ethylene and propylene are most preferred. Other alphaolefins suitable in place of propylene to form the copolymer, or to be used in combination with ethylene and propylene, to form a terpolymer, tetrapolymer, etc., include 1-butene, 1-pentene, 1-hexane, 1-heptene, 1-octene, etc.; also branched chain alpha-olefins, such as 4-methyl-1-pentene, 4-methyl-1-hexene, 5-methylpentene-1, 4,4-dimethyl-1-pentene, and 6-methyl-heptene-1, etc., and mixtures thereof. Also useful are ethylene alphaolefin copolymers, such as ethylene-propylene copolymers, also containing a small amount of one or more non-conjugated dienes; such polymers are known in the art as ethylene-propylene terpolymers or EPDM. When present, the amount of the non-conjugated diolefin generally ranges from greater than zero, for example from about 0.5, to about 10 weight percent, preferably from about 1 to about 7 weight percent, based on the total amount of ethylene and alphaolefin present. Blends of ethylene propylene copolymers are useful, including blends of amorphous or substantially amorphous copolymers with partially crystalline copolymers. When blends or mixtures of ethylene propylene copolymers are used, the ethylene content values recited herein typically apply to the mixture. That is to say, if an individual copolymer in the mixture has an ethylene content that is less than about 30 wt. %, but is blended with a higher ethylene content copolymer such that the ethylene content of the mixture is greater than about 30 wt. %, then such mixture is considered to be within the scope of the present invention. The same reasoning applies to copolymers having ethylene content values at the upper end of the specified range, further provided that the maximum ethylene content of any component of a V.I. mixture should be such that the copolymer molecule remains soluble in the oil composition. Furthermore, other types of viscosity index improvers well known in the art (for example polyisobutylene, homopolymers and copolymers of $C_6$ and higher alphaolefins, hydrogenated polymers and copolymers and terpolymers of styrene, e.g., with isoprene and/or butadiene, etc.) can be present and used in combination with the high ethylene content ethylene alphaolefin copolymers. Ethylene content can be measured using the procedure specified in ASTM-D3900 for ethylene-propylene copolymers between 35 wt. % and 85 wt. % ethylene. Above 85 wt. %, ASTM-D2238 can be used to obtain methyl group concentration which is related to percent ethylene in an unambiguous manner for ethylene-propylene copolymers. When comonomers other than propylene are employed, no ASTM tests covering a wide range of ethylene contents are available; however, proton and carbon-13 nuclear magnetic resonance spectroscopy can be employed to determine the composition of such polymers. These are absolute techniques requiring no calibration when operated such that all nucleii of a given element contribute equally to the spectra. For ethylene content ranges not covered by the ASTM tests for ethylene-propylene copolymers, as well as for any ethylene-propylene copolymers, these nuclear magnetic resonance methods can also be used.

The total V.I. improver concentration, particularly in the form of a high ethylene content ethylene alphaolefin content copolymer, will typically be employed in the final lubricating oil composition in amounts of from about 0.2 to 2.8 wt. %, with the precise amount being selected on the basis of the particular type and amount of basestock as well as the targeted properties of the lubricating oil composition.

The V.I. copolymer or mixtures thereof may be degraded in molecular weight, for example by mastication, extrusion, oxidation or thermal degradation, and it may be oxidized and contain oxygen. When mixtures are used, such degradation may be carried out on one or more individual copolymers that are subsequently blended or on blended mixtures of such copolymers. Also included are derivatized polymers such as post-grafted copolymers of ethylene-propylene with an active monomer such as maleic anhydride which may be further reacted with an alcohol, or amine, e.g., an alkylene polyamine or hydroxy amine, e.g., see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489; and 4,149,984; the disclosures of these patents are incorporated by reference to the extent permitted. Furthermore, the polymerization method and/or catalyst system that is used to prepare the ethylene alphaolefin copolymer useful in the present invention is not critical to the practice of the invention. Any process useful for preparing such copolymers can be employed, including batch reactors, continuous stirred tank reactors and tubular reactors as well as the use of catalyst systems such as Ziegler-Natta, metallocene, constrained geometry and diimine catalyst systems. Various ethylene copolymers useful in the present invention, including methods of polymerization, derivatization, blending, and degradation are conveniently summarized in contemporaneously filed, copending U.S. patent application Ser. No. 09/845,756, filed May 1, 2001 (and also assigned to the same assignee as the present application), the disclosure of which is incorporated herein to the extent permitted.

The lubricating oil compositions of the present invention employ basestock or base oil that may be either natural, synthetic or a mixture of natural and synthetic base oils. Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the dual additive composition of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

However, the dual additive LOFI composition of the present invention is particularly effective when present in compositions in which the base oil is primarily a "Group II" and/or "Group III" basestock. These basestocks have become more important recently as automobile manufacturers and government regulators introduce more stringent performance criteria for engines and lubricating oils, particularly as directed to oil volatility and fuel efficiency. The relationship of these criteria to basestock properties and the difficulties in meeting such performance criteria is further described in *Lubes'N'Greases,* 6 (3), 6 (2000) and 5 (3), 26 (1999) and in the article "The Effect of High Quality Basestocks on PCMO Fuel Economy" by K. Crosthwait, et al., presented at the 1999 Lubricants & Waxes Meeting of the National Petrochemical & Refiners Association (Nov. 11–12, 1999). Group classifications or designations have been established by the American Petroleum Institute (API) according to the following table:

| Group | Saturates | Sulfur | Viscosity Index |
|---|---|---|---|
| I | <90% | and /or >0.03% | ≧80 and <120 |
| II | ≧90% | ≦0.03% | ≧80 and <120 |
| III | ≧90% | ≦0.03% | ≧120 |
| IV | | Restricted to PAOs | |
| V | | All other basestocks | |

Furthermore, most commercial Group II basestocks have had viscosity index values in the range of about 95 to about 100. Consequently, Group II basestocks having viscosity indices in the range of about 110 to 119 as well as the other characteristics of Group II basestocks have come to be unofficially identified as "Group II+" basestocks. Typically, in order to produce the high viscosity index basestocks of Group II, refiners convert naphthenics present in the base oil to isoparaffins. Since isoparaffins can be less responsive to LOFIs there has been a need for further improvements in LOFI technology. The present invention is particularly useful when Group II basestocks are employed in the lubricating oil formulation, more particularly when Group II+ basestocks are used and also when Group III basestocks are used; mixtures of Group II and Group III basestocks can also be employed with the LOFIs of the present invention. Furthermore, the present invention is also effective when Group II, Group II+ and/or Group III basestocks are used in admixture with Group I basestocks, and further wherein the Group II+ and/or Group III basestocks are present in an amount of at least about 20 percent by weight. It is most useful with one or more of such basestocks and when there is also present one or more high ethylene content viscosity index improver as described hereinabove. It will be observed from the above table that the viscosity index for Group III basestocks as defined by the API is open-ended, i.e., it is expressed as greater than 120. For purposes of the present invention, all Group III basestocks are suitable for use with the current invention and an upper limiting value is not necessary to be encompassed herein, i.e., if a basestock is characterized as a Group III basestock under the API scheme, it is within the scope of the present invention regardless of how high its viscosity index. However, for purposes of clarity, it can be said that Group III basestocks are expected to have a viscosity index of equal to or greater than 120 and: equal to or less than 200; preferably equal to or less than 180; most preferably equal to or less than 160. Group II and Group III basestocks are available commercially from several producers including ExxonMobil, Chevron, Petro-Canada, Excel Paralubes and Motiva Enterprises. The processes used by various manufacturers are not necessarily the same, but basestocks characterized by the "Group" designation will meet the characteristics defined above.

The dual additive compositions of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the dual additive composition, for instance, is soluble or stably dispersible in oil to an extent sufficient to exert its intended effect in the environment in which the oil is employed. Moreover, the additional incorporation of other additives may also permit incorporation of higher levels of a particular dual additive composition hereof, if desired. Accordingly, while any effective amount of the dual additive composition can be incorporated into the final, e.g., fully formulated, lubricating oil composition, it is contemplated that such effective amount be sufficient to provide said lube oil composition with an amount of the dual additive composition of typically less than 10 wt. %, more typically less than 1 wt. %, preferably from about 0.005 to about 0.7 wt. %, e.g., from about 0.02 to about 0.5 wt. %, and more preferably from about 0.05 to about 0.3 wt. %, based on the weight of said lubricating composition.

Effective amounts of each of the LOFI components is conveniently expressed as a ratio of the defined lower average side chain carbon number copolymer (alternatively referred to as lower melting point or first component) to the defined higher average side chain carbon number copolymer (alternatively referred to as the higher melting point or second component) as follows: from about 95:5 to about 40:60; preferably from about 90:10 to about 60:40; and most preferably from about 85:15 to about 75:25. In other words, in a most preferred embodiment there will be a higher concentration of the first defined component to the second defined component present in the final composition.

The dual additive composition of the present invention can be incorporated into the lubricating oil in any convenient way. Thus, it can be added directly to the oil by dispersing, or dissolving the same in the oil at the desired level of concentration. Such blending can occur at room temperature or elevated temperatures. Alternatively, the dual additive composition may be blended with a base oil to form a concentrate, and the concentrate then blended with lubricating oil basestock to obtain the final composition. Such concentrates will typically contain the dual additive composition in amounts of from about 2.0 to about 90, and preferably from about 40 to 80 percent, by weight, based on the concentrate weight. The concentrate can also include the V.I. improver.

The dual additive composition of the present invention can be employed in a lubricating oil composition which comprises lubricating oil or basestock, typically in a major amount, and the dual additive composition, typically in a minor amount, which is effective to impart the enhanced flow properties described herein. Additional conventional additives selected to meet the particular requirements of a selected type of lubricating oil composition can be included as desired. The lubricating oil basestock for the dual additive composition of the present invention typically is adapted to perform selected functions by the incorporation of additives therein to form lubricating oil compositions designated as formulations or "fully formulated oils". Representative additives typically present in such formulations include corrosion inhibitors, oxidation inhibitors, friction modifiers, dispersants, anti-foaming agents, anti-wear agents, detergents, rust inhibitors and the like.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. percent of a sulfide of phosphorus for ½ to 15 hours, at a temperature in the range of 150° F. to 600° F. (66° C. to 316° C.). Neutralization of the phosphosulfurized hydrocarbon may be effected in the manner taught in U.S. Pat. No. 1,969,324.

Oxidation inhibitors reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids. Representative examples of suitable friction modifiers are found in U.S. Pat. No. 3,933,659 that discloses fatty acid esters and amides; U.S. Pat. No. 4,176,074 that describes molybdenum complexes of polyisobutenyl succinic anhydride-amino alkanols; U.S. Pat. No. 4,105,571 that discloses glycerol esters of dimerized fatty acids; U.S. Pat. No. 3,779,928 that discloses alkane phosphonic acid salts; U.S. Pat. No. 3,778,375 that discloses reaction products of a phosphonate with an oleamide; U.S. Pat. No. 3,852,205 that discloses S-carboxyalkylene hydrocarbyl succinimide, S-carboxyalkylene hydrocarbyl succinamic acid and mixtures thereof; U.S. Pat. No. 3,879,306 that discloses N-(hydroxyalkyl)alkenyl-succinamic acids or succinimides; U.S. Pat. No. 3,932,290 which discloses reaction products of di-(lower alkyl) phosphites and epoxides; and U.S. Pat. No. 4,028,258 that discloses the alkylene oxide adduct of phosphosulfurized N-(hydroxyalkyl) alkenyl succinimides. Preferred friction modifiers include succinate esters, or metal salts thereof, of hydrocarbyl substituted succinic acids or anhydrides and thiobis alkanols such as described in U.S. Pat. No. 4,344,853 as well as various molybdenum compounds.

Dispersants maintain compounds resulting from oxidation during use that are insoluble or substantially insoluble in the oil, in suspension in the fluid thus preventing sludge flocculation and precipitation or deposition on metal parts. Suitable dispersants include high molecular weight alkyl succinates, the reaction product of oil-soluble polyisobutylene succinic anhydride with ethylene amines such as tetraethylene pentamine and borated salts thereof.

Foam control can be provided by an antifoamant of the polysiloxane type, e.g., silicone oil and polydimethyl siloxane.

Anti-wear agents, as their name implies, reduce wear of metal parts. Representatives of conventional anti-wear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz., overbased) metal salts, such as highly basic alkaline earth metal sulfonates (especially Ca and Mg salts) are frequently used as detergents. Representative examples of such materials, and their methods of preparation, are found in U.S. Pat. No. 6,127,321 based on an application originally filed Jul. 11, 1985.

Compositions when containing these conventional additives are typically blended into the base oil in amounts that are effective to provide their normal attendant function. It is also known that some of these additives can provide more than one effect, e.g., a dispersant-oxidation inhibitor or a dispersant-viscosity index improver. Representative effective amounts of such additives are illustrated as follows:

| Additive | % Active Ingredient By Volume | % Active Ingredient By Weight |
|---|---|---|
| Corrosion Inhibitor | 0.01–1 | 0.01–1.5 |
| Oxidation Inhibitor | 0.01–1 | 0.01–1.5 |
| Dispersant | 0.1–7 | 0.1–8 |
| Anti-Foaming Agents | 0.001–0.1 | 0.001–0.15 |
| Anti-Wear Agents | 0.001–1 | 0.001–1.5 |
| Friction Modifiers | 0.01–1 | 0.01–1.5 |
| Detergents/Rust Inhibitors | 0.01–2.5 | 0.01–3 |
| Lubricating Oil Basestock | Balance | Balance |

When other additives are employed, it may be desirable, although not necessary, to prepare additive concentrates comprising concentrated solutions or dispersions of the dual additive composition (in concentrate amounts hereinabove described), together with one or more of said other additives (said concentrate when constituting an additive mixture being referred to herein as an additive-package) whereby several additives can be added simultaneously to the base oil or basestock to form the lubricating oil composition. Dissolution of the additive concentrate into the lubricating oil may be facilitated by solvents and by mixing accompanied with mild heating, but this is not essential. The concentrate or additive-package will typically be formulated to contain the dual additive composition and optional additional additives in proper amounts to provide the desired concentration in the final formulation when the additive-package is combined with a predetermined amount of basestock. Thus, the dual additive composition of the present invention can be added to small amounts of base oil or other compatible solvents along with other desirable additives to form additive-packages containing active ingredients in collective amounts of typically from about 2.0 to about 90 wt. %, and preferably from about 5 to about 75 wt. %, and most preferably from about 8 to about 50 wt. % additives in the appropriate proportions with the remainder being base oil. The final formulations may employ typically about 10 wt. % of the additive-package with the remainder being base oil. All of said weight and volume percents expressed herein are based on active ingredient (a.i.) content of the additive, and/or upon the total weight of any additive-package, or formulation which will be the sum of the a.i. weight of each additive plus the weight of total oil or diluent.

The following examples are given as specific illustrations of the claimed invention. It should be understood, however, that the invention is not limited to the specific details set forth in the examples. All parts and percentages in the examples, as well as in the remainder of the specification, are by weight unless otherwise specified.

EXAMPLE 1

Comparison of $C_{12.0}$-FVA and $C_{13.2}$-FVA with Commercial LOFIs in Group II Basestock An SAE 5 W-30 formulation was prepared consisting of 9.75% of a detergent-inhibitor additive package (including the following components: polyisobutenyl succinimide dispersant, calcium sulfonate detergent, zinc dialkyldithiophosphate antiwear agent, diaryl amine antioxidant), 8.10% of a viscosity index improver and 82.15% of a Group 2 basestock. The viscosity index improver consisted of a mixture of 20 wt. % of an ethylene-propylene copolymer containing 50 wt. % ethylene and 80 wt. % of an ethylene-propylene copolymer containing 72 wt. % ethylene. The basestock had a kinematic viscosity of 22 cSt at 40° C. and 4.5 cSt at 100° C., a viscosity index of 118 and a pour point of −18° C. The resulting formulation without LOFI had a cold-cranking viscosity in the CCS test at −25° C. of 2,500 cP and a pour point of −21° C.

A comparison of the low-temperature performance of the various LOFIs is shown in Tables 1–3. LOFI-1 is a dialkyl fumarate/vinyl acetate copolymer having an average side chain carbon number of 12.3 that is known to be effective in reducing pour point. LOFI-3 is also a dialkyl fumarate/vinyl acetate copolymer having an average side chain carbon number of 13.2 that is known to be effective in reducing the MRV TP-1 apparent viscosity in basestocks with high wax content and with tapered block OCP viscosity index improvers. The dialkyl fumarate/vinyl acetate copolymers were prepared by reacting the particular dialkyl fumarate monomer with vinyl acetate by means of a free radical polymerization initiated with tert-butyl peroctoate. The average carbon number of these copolymers was determined by $^{13}$C-NMR .

As shown in Tables 1–3, the $C_{12.0}$-FVA is superior to either LOFI-1 or LOFI-3 or their combination. However, although the pour point of the oil decreases as the concentration of the $C_{12.0}$-FVA is increased, both the MRV TP-1 apparent viscosity and the Scanning Brookfield gel index values are poorer (i.e., increase).

The combination of a $C_{12.0}$-FVA and a $C_{13.2}$-FVA in an 80:20 ratio enables the use a higher LOFI treat rate (higher concentration) in order to achieve the required pour point, without degrading the performance of the MRV TP-1 apparent viscosity and Scanning Brookfield gel index.

TABLE 1

| LOFI Conc. (%) | Pour Point (° C.) LOFI-1 | LOFI-1 + LOFI-3 | LOFI-3 | $C_{12.0}$ FVA | $C_{12.0}$-FVA + $C_{13.2}$-FVA |
|---|---|---|---|---|---|
| 0.10 | — | — | — | −33, −33 | −33 |
| 0.15 | −33, −33 | −30 | −27 | — | — |
| 0.20 | −33, −33, −33 | −33 | −27 | −33, −33 | −36, −36 |
| 0.25 | −33, −36 | −30 | −27 | — | −36, −36 |
| 0.30 | −33 | −33 | −27 | −33, −36, −36 | −36 |

TABLE 2

| LOFI Conc. (%) | Mini-Rotary Viscometer (MRV) TP-1 Apparent Viscosity LOFI-1 | LOFI-1 + LOFI-3 | LOFI-3 | $C_{12.0}$ FVA | $C_{12.0}$-FVA + $C_{13.2}$-FVA |
|---|---|---|---|---|---|
| 0.10 | — | — | — | 27,800 | 35,300 |
| 0.15 | 35,200 | — | Solid[1] | — | — |
| 0.20 | 30,600, 48,900 | — | — | 25,600, 29,500, 23,300 | 32,900, 27,200 |
| 0.25 | 44,300 | — | — | — | 24,700, 29,700 |
| 0.30 | — | — | Solid[1] | 41,700[1], 42,600 | 33,900 |

Footnote:
[1]Yield Stress Failure

TABLE 3

| Scanning Brookfield Gel Index | | | | | |
|---|---|---|---|---|---|
| LOFI Conc. (%) | LOFI-1 | LOFI-1 + LOFI-3 | LOFI-3 | $C_{12.0}$ FVA | $C_{12.0}$-FVA + $C_{13.2}$-FVA |
| 0.10 | — | — | — | 6.5 | 7.4 |
| 0.15 | 9.9 | — | 8.2 | — | — |
| 0.20 | 9.7 | — | — | 8.2, 9.3 | 6.8, 6.5 |
| 0.25 | — | — | 6.6 | — | 5.9, 4.5 |
| 0.30 | — | — | — | 12.1 | 7.5 |

EXAMPLE 2

Formulation Containing a High-Ethylene Content Olefin Copolymer Viscosity Index Improver An SAE 5 W-30 formulation was prepared consisting of 9.75% of a detergent-inhibitor additive package (as described in Example 1), 8.60% of a viscosity index improver and 81.65% of a Group II basestock. The viscosity index improver was an ethylene-propylene copolymer containing 72 wt. % ethylene. The basestock had a kinematic viscosity of 22 cSt at 40° C. and 4.5 cSt at 100° C., a viscosity index of 118 and a pour point of −18° C. The resulting formulation without LOFI had a CCS viscosity at −25° C. of 2,300 cP and a pour point of −21° C.

The use of a high-ethylene content OCP in such a formulation undesirably increases the pour point of the lubricating oil. In order to overcome this pour point debit, the prior art has taught that combinations of high- and low-ethylene content OCPs can be used (see Engel et al., U.S. Pat. No. 3,697,429). However, this approach represents a compromise. As low-ethylene content OCP is added to the high-ethylene content OCP to improve the responsiveness of the lubricating oil to the LOFI, the treat rate of the viscosity index improver needs to be increased, the thickening efficiency of the viscosity index improver decreases, and the cold cranking viscosity (CCS) of the composition increases.

As shown in Table 4, neither LOFI-1 nor LOFI-3 (as described in Example 1), nor their mixture, is effective in reducing the pour point to the target level for an SAE 5 W-30 oil (−36° C.). However, the combination of the $C_{12.0}$-FVA and $C_{13.2}$-FVA did reduce the pour point, while maintaining MRV TP-1 apparent viscosity.

TABLE 4

| Performance of SAE 5W-30 Containing High-Ethylene Content OCP Viscosity Index Improver[1] | | | | |
|---|---|---|---|---|
| Test | LOFI-1 | LOFI-1 + LOFI-3 | LOFI-3 | $C_{12.0}$-FVA + $C_{13.2}$-FVA |
| MRV TP-1 Viscosity | 26,900 | 40,800 | Solid[2] | 27,300 |
| Pour Point (° C.) | −30 | −30 | −27 | −36 |
| Gel Index | 8.3 | 12.0 | 11.9 | 8.2 |

Footnotes:
[1]LOFI Concentration = 0.20 wt. %
[2]Yield Stress Failure

EXAMPLE 3

Comparison of $C_{12.0}$-FVA and $C_{13.2}$-FVA with Standard LOFIs in a Mixture of Group I and Group III Basestocks An SAE 5 W-30 formulation was prepared consisting of 8.90% of a detergent-inhibitor additive package (as described in Example 1), 8.50% of a viscosity index improver and 45.43% of a Group I basestock and 37.17% of a Group III basestock. The viscosity index improver consisted of a mixture of 20 wt. % of an ethylene-propylene copolymer containing 50 wt. % ethylene and 80 wt. % of an ethylene-propylene copolymer containing 72 wt. % ethylene.

As shown in Table 5, neither of the standard LOFIs (LOFI-1 and LOFI-3 as previously described; LOFI-4 is a dialkyl fumarate/vinyl acetate copolymer having an average side chain carbon number of 14.0), nor their combinations resulted in passing performance in this basestock mixture (all failed yield stress), but the combination of the $C_{12.0}$-FVA and the $C_{13.2}$-FVA resulted in excellent low-temperature performance.

TABLE 5

| Low-Temperature Performance in an SAE 5W-30 Composition of a Mixture of Group I & Group III Basestocks[1] | | | | | | | | | |
|---|---|---|---|---|---|---|---|---|---|
| LOFI Conc. (%) | LOFI-1 | LOFI-3 | LOFI-1 + LOFI-3 (50:50) | LOFI-1 + LOFI-3 (80:20) | LOFI-1 + LOFI-4 (50:50) | LOFI-1 + LOFI-4 (80:20) | LOFI-3 + LOFI-4 (50:50) | LOFI-3 + LOFI-4 (80:20) | $C_{12.0}$-FVA + $C_{13.2}$-FVA (80:20) |
| 0.10 | | | | | | | | | 27,300/ −30/11.4 |
| 0.15 | 48,900[2] | Solid[2] | 69,100[2]/ −30 | 67,500[2]/ −30 | 140,000[2]/ −30 | 65,200[2]/ −30 | Solid[2] / −27 | Solid[2]/ −27 | 24,600/ −33/8.2 |
| 0.20 | 43,500[2] | | | | | | | | 25,900/ −36/15.8 |
| 0.25 | | | | | | | | | 32,500/ −36/9.2 35,300/ −36 |

Footnotes:
[1]Test results: MRV TP-1 Viscosity/Pour Point/Gel Index
[2]Yield Stress Failure

EXAMPLE 4

Effect of $C_{12.0}$-FVA to $C_{13.2}$-FVA Ratio

An SAE 5 W-30 formulation was prepared consisting of 9.75% of a detergent-inhibitor additive package (as described hereinabove), 8.10% of a viscosity index improver and 82.15% of a Group II basestock. The viscosity index improver consisted of a mixture of 20 wt. % of an ethylene-propylene copolymer containing 50 wt. % ethylene and 80 wt. % of an ethylene-propylene copolymer containing 72 wt. % ethylene. The basestock had a kinematic viscosity of 22 cSt at 40° C. and 4.5 cSt at 100° C., a viscosity index of 118 and a pour point of −18° C. The resulting formulation without LOFI had a cold-cranking (CCS) viscosity at −25° C. of 2,500 cP and a pour point of −21° C.

The ratio of the $C_{12.0}$-FVA to the $C_{13.2}$-FVA was varied from 100:0 to 0:100. As shown in Table 6, optimum low-temperature performance as indicated by overall low-temperature performance was observed (using 0.25 wt. % LOFI) when the ratio of the $C_{12.0}$-FVA to $C_{13.2}$-FVA was greater than about 40:60.

TABLE 6

Effect of $C_{12.0}$-FVA to $C_{13.2}$-FVA Ratio[1]

| LOFI Conc. | $C_{12.0}$-FVA:$C_{13.2}$-FVA Ratio | | | | | |
|---|---|---|---|---|---|---|
| (%) | 100:0 | 80:20 | 75:25 | 67:33 | 33:67 | 0:100 |
| 0.25 | | 24,700 / −36 / 5.9; 29,700 / −36 / 4.5 | 26,100 / −33 / 6.1 | 29,300 / −36 / 7.4; 28,400 / −36 / 6.4 | 36,000 / −36 / 8.5 | Solid / −27 / 6.6 |
| 0.30 | 41,700 / −33, −36 / 8.2; 42,600 / −36 / 12.1 | 33,900 / −36 / 6.8 | | | | |

Footnote:
[1]Test results: MRV TP-1 Viscosity / Pour Point / Gel Index

EXAMPLE 5

Formulation Containing a High-Ethylene Content Olefin Copolymer Viscosity Index Improver An SAE 10 W-40 formulation was prepared consisting of 9.75% of a detergent-inhibitor additive package (as described hereinabove), 10.30% of a viscosity index improver and 79.95% of a Group II basestock. The viscosity index improver was an ethylene-propylene copolymer containing 72 wt. % ethylene. The basestock had a kinematic viscosity of 36.6 cSt at 40° C. and 6.1 cSt at 100° C., a viscosity index of 113 and a pour point of −18° C. The resulting formulation without LOFI had a cold-cranking viscosity at −20° C. of 3,200 cP and a pour point of −18° C.

As shown in Table 7, neither standard LOFI composition (as described hereinabove), nor their mixture, was effective in reducing the pour point to the target value for an SAE 10 W-40 oil (−30° C.). However, the combination of the $C_{12.0}$-FVA and the $C_{13.2}$-FVA reduced the pour point, while maintaining MRV TP-1 apparent viscosity.

TABLE 7

Performance of SAE 10W-40 Containing High-Ethylene Content OCP Viscosity Index Improver[1]

| LOFI Conc. (%) | LOFI-1 | LOFI-1 + LOFI-3 | LOFI-3 | $C_{12.0}$-FVA | $C_{12.0}$-FVA + $C_{13.2}$-FVA |
|---|---|---|---|---|---|
| 0.10 | — | — | — | 43,900[2] / −24 | 34,300 / −24 |

TABLE 7-continued

Performance of SAE 10W-40 Containing High-Ethylene Content OCP Viscosity Index Improver[1]

| LOFI Conc. (%) | LOFI-1 | LOFI-1 + LOFI-3 | LOFI-3 | $C_{12.0}$-FVA | $C_{12.0}$-FVA + $C_{13.2}$-FVA |
|---|---|---|---|---|---|
| 0.20 | 26,000 / −27 | 29,200 / −27 | 82,200[2] / −27 | 34,100[2] / −27 | 27,500 / −30 |

Footnotes:
[1]Test Results: MRV TP-1 Viscosity / Pour Point (° C.)
[2]Yield Stress Failure

EXAMPLE 6

Comparison of $C_{10}$, $C_{11}$, and $C_{12}$ Fumarate-Vinyl Acetate Copolymers An SAE 5 W-30 formulation was prepared consisting of 9.75% of a detergent-inhibitor additive package (as described hereinabove), 8.10% of a viscosity index improver and 82.15% of a Group II basestock. The viscosity index improver consisted of a mixture of 20 wt % of an ethylene-propylene copolymer containing 50 wt. % ethylene and 80 wt. % of an ethylene-propylene copolymer containing 72 wt. % ethylene. The basestock had a kinematic viscosity of 22 cSt at 40° C. and 4.5 cSt at 100° C., a viscosity index of 118 and a pour point of −18° C. The resulting formulation without LOFI had a cold-cranking viscosity at −25° C. of 2,500 cP and a pour point of −21° C.

An SAE 10 W-40 formulation was prepared consisting of 9.75% of a detergent-inhibitor additive package (as described above), 10.50% of a viscosity index improver and 79.75% of a Group II basestock. The viscosity index improver consisted of a mixture of 20 wt. % of an ethylene-propylene copolymer containing 50 wt. % ethylene and 80 wt. % of an ethylene-propylene copolymer containing 72 wt. % ethylene. The basestock had a kinematic viscosity of 36.6 cSt at 40° C. and 6.1 cSt at 100° C., a viscosity index of 113 and a pour point of −18° C. The resulting formulation without LOFI had a cold-cranking viscosity at −20° C. of 3,400 cP and a pour point of −18° C.

A $C_{10.0}$-FVA, synthesized from n-decyl alcohol, and a $C_{11.0}$-FVA, synthesized from an equimolar mixture of n-decyl alcohol and n-dodecyl alcohol (using the procedure described in Example 1), were evaluated in both the SAE 5 W-30 and the SAE 10 W-40. As shown in Table 8, neither the $C_{10.0}$-FVA nor the $C_{11.0}$-FVA alone or in combination with LOFI-1 or the $C_{13.2}$-FVA, was as effective as the combination of the $C_{12.0}$-FVA and the $C_{13.2}$-FVA.

TABLE 8

Performance Comparison of $C_{10}$ $C_{11}$, $C_{12}$ Fumarate-Vinyl Acetate Copolymers

| LOFI | LOFI Conc. (%) | SAE 5W-30[1,2] | SAE 10W-40[1,2] |
|---|---|---|---|
| $C_{10.0}$-FVA | 0.20 | Solid[3] / −21 | Solid[3] / −18 |
| $C_{10.0}$-FVA + LOFI-1 | 0.16 + 0.04 | Solid[3] / −27 | 450,500[3] / −24 |
| $C_{10.0}$-FVA + $C_{13.2}$-FVA | 0.16 + 0.04 | Solid[3] / −21 | 59,900 / −24 / 7.9[4] |
| $C_{11.0}$-FVA | 0.20 | Solid[3] / −21 | Solid[3] / −21 |
| $C_{11.0}$-FVA + LOFI-1 | 0.16 + 0.04 | 138,500 / −27 | 70,900[3]/ −27 |
| $C_{11.0}$-FVA + $C_{13.2}$-FVA | 0.16 + 0.04 | Solid[3] / −21 | 231,000[3]/ −24 |

TABLE 8-continued

| Performance Comparison of $C_{10}$ $C_{11}$, $C_{12}$ Fumarate-Vinyl Acetate Copolymers | | | |
|---|---|---|---|
| LOFI | LOFI Conc. (%) | SAE 5W-30[1,2] | SAE 10W-40[1,2] |
| $C_{12.0}$-FVA + $C_{13.2}$-FVA | 0.16 + 0.04 | 30,200 / −36 / 11.6[4] | 34,600 / −30 / 6.9[4] |

Footnotes:
[1]MRV TP-1 Viscosity / Pour Point (° C.)
[2]MRV TP-1 Test Temperature: −35° C. for SAE 5W-30; −30° C. for SAE 10W-40
[3]Yield Stress Failure
[4]Gel Index Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. An additive composition for improving at least the low temperature flow properties of a lubricating oil composition comprising at least one lubricating oil basestock selected from the group consisting of lubricating oils of greater than or equal to 90 wt. % saturates and less than or equal to 0.03 wt. % sulfur and a viscosity index in the range of greater than or equal to 80 and equal to or less than 200, and at least one viscosity index improver selected from the group consisting of copolymers of ethylene and at least one $C_3$ to about $C_{18}$ alphaolefin, wherein the ethylene content of said ethylene containing copolymer is greater than about 30 wt. % to about 85 wt. %, said additive composition comprising a mixture of:

(A) first added lubricating oil flow improver component containing pendent ester groups having repeating methylene units derived from a mixture of alcohols present within the structure of said pendant ester groups, comprising a copolymer of (i) a first monomer of an ester of an unsaturated dicarboxylic acid or its corresponding anhydride having the formula:

(I)

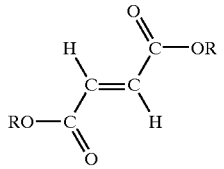

wherein R is selected from the group consisting of from about $C_6$ to about $C_{24}$ alkyl group provided that the average side chain carbon number is between 11.5 and 12.3 and (ii) a second monomer selected from the group consisting of (a) vinyl ester represented by the formula:

(II)

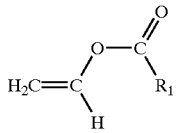

wherein $R_1$ comprises an alkyl group containing from 1 to about 18 carbon atoms, (b) about $C_6$ to about $C_{46}$ straight or branched chain alpha-monoolefin, and (c) styrene; or a polymer or copolymer of unsaturated mono-ester represented by the formula:

(IV)

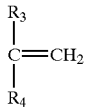

wherein $R_3$ is hydrogen or a $C_1$ to $C_5$ alkyl group; and $R_4$ is a $COOR_5$ group wherein $R_5$ is a $C_1$ to $C_{20}$ alkyl, with the proviso that the average number of carbon atoms in the groups constituting $R_5$ in the polymer or copolymer is between 11.5 and 12.2 and (B) second added lubricating oil flow improver component containing pendent ester groups having repeating methylene units derived from a mixture of alcohols present within the structure of said pendant ester groups, comprising a copolymer of (i) a first monomer of an ester of an unsaturated dicarboxylic acid or its corresponding anhydride having the formula:

(III)

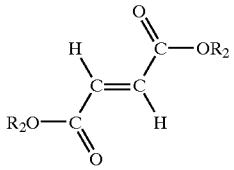

wherein $R_2$ is selected from the group consisting of from about $C_6$ to about $C_{24}$ alkyl group provided that the average side chain carbon number is between 12.7 and 15.0 and (ii) a second monomer selected from the group consisting of said second monomers set forth in (A)(ii), provided however, that when the second monomer corresponds to formula (IV) then the average number of carbon atoms in the groups constituting $R_5$ in the polymer or copolymer is between 12.7 and 15.0; and wherein the weight ratio of said first component to said second component in said composition is from about 95:5 to about 40:60.

2. The additive composition of claim 1 wherein said unsaturated dicarboxy ester comprises dialkyl fumarate and said vinyl ester comprises vinyl acetate.

3. The additive composition of claim 2 wherein the average side chain carbon number of said first component is from about 11.5 to about 12.2 and the average side chain carbon number of said second component is from about 12.8 to about 14.0.

4. The additive composition of claim 3 wherein the moles of vinyl acetate to moles of dialkyl fumarate used in preparing the copolymers of said first and second components is from about 3.0:1 to 0.33:1.

5. The additive composition of claim 4 wherein the number average molecular weight of said first and second components is from about 4,000 to about 60,000.

6. The additive composition of claim 4 in combination with a viscosity index improving amount of said viscosity index improver.

7. The additive composition of claim 6 wherein said at least one $C_3$ to $C_{18}$ alphaolefin comprises propylene said viscosity index improver has a number average molecular weight of between about 20,000 and 500,000.

8. The additive composition of claim 7 wherein said viscosity index improver further includes greater than 0 to about 10 wt. % of a nonconjugated diene.

9. The additive composition of claim 4 wherein the weight ratio of the amount of said first component to the amount of said second component in said composition is from about 90:10 to about 60:40.

10. The additive composition of claim 1 wherein said first and/or said second component is a copolymer comprised of (a) esterified $C_4$ to $C_{10}$ mono-ethylenically unsaturated dicarboxylic acid or anhydride, wherein the carboxyl groups are located on vicinal carbons, and (b) at least one $C_6$ to $C_{46}$ alpha-monoolefin.

11. The additive composition of claim 10 wherein in said copolymer, said esterified dicarboxylic acid or anhydride is derived from maleic anhydride.

12. The additive composition of claim 1 wherein said first and/or said second component is a copolymer comprised of (a) esterified $C_4$ to $C_{10}$ mono-ethylenically unsaturated dicarboxylic acid or anhydride, wherein the carboxyl groups are located on vicinal carbons and (b) styrene.

13. The additive composition of claim 12 wherein said second copolymer is a styrene esterified maleic anhydride interpolymer.

14. A lubricating oil composition comprising a dual additive composition in an amount and additive ratio effective to improve, relative to the absence of one or more components of said dual additive composition, at least the low temperature flow properties of said lubricating oil composition when said lubricating oil composition comprises at least one lubricating oil basestock selected from the group consisting of lubricating oils of greater than or equal to 90 wt. % saturates and less than or equal to 0.03 wt. % sulfur and a viscosity index in the range of greater than or equal to 80 and less than about 200, and at least one viscosity index improver selected from the group consisting of copolymers of ethylene and at least one $C_3$ to about $C_{18}$ alphaolefin, wherein the ethylene content of said ethylene containing copolymer is greater than about 30 wt. % to about 85 wt. %, said dual additive composition comprising a mixture of:

(A) first added lubricating oil flow improver component containing pendent ester groups having repeating methylene units derived from a mixture of alcohols present within the structure of said pendant ester groups, comprising a copolymer of (i) a first monomer of an ester of an unsaturated dicarboxylic acid or its corresponding anhydride having the formula:

(I)

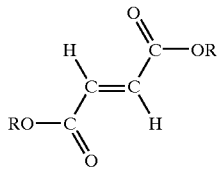

wherein R is selected from the group consisting of from about $C_6$ to about $C_{24}$ alkyl group provided that the average side chain carbon number is between 11.5 and 12.2 and (ii) a second monomer selected from the group consisting of (a) vinyl ester represented by the formula:

(II)

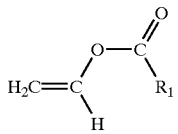

wherein $R_1$ comprises an alkyl group containing from 1 to about 18 carbon atoms, (b) about $C_6$ to about $C_{46}$ straight or branched chain alpha-monoolefin, and (c) styrene; or a polymer or copolymer of unsaturated mono-ester represented by the formula:

(IV)

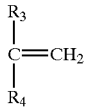

wherein $R_3$ is hydrogen or a $C_1$ to $C_5$ alkyl group; and $R_4$ is a $COOR_5$ group wherein $R_5$ is a $C_1$ to $C_{20}$ alkyl, with the proviso that the average number of carbon atoms in the groups constituting $R_5$ in the polymer or copolymer is between 11.5 and 12.2, and (B) second added lubricating oil flow improver component containing pendent ester groups having repeating methylene units derived from a mixture of alcohols present within the structure of said pendant ester groups, comprising a copolymer of (i) unsaturated dicarboxy ester having the formula:

(III)

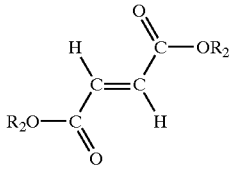

wherein $R_2$ is selected from the group consisting of from about $C_6$ to about $C_{24}$ alkyl group provided that the average side chain carbon number is between 12.7 and 15.0 and (ii) a second monomer selected from the group consisting of said second monomers set forth in (A)(ii), provided however, that when the second monomer corresponds to formula (IV) then the average number of carbon atoms in the groups constituting $R_5$ in the polymer or copolymer is between 12.7 and 15.0; and wherein the weight ratio of said first component to said second component in said composition is from about 95:5 to about 40:60.

15. The lubricating oil composition of claim 14 wherein said basestock has a viscosity index of between about 110 to 119.

16. The lubricating oil composition of claim 14 wherein said lubricating oil has a viscosity of between about 2.5 and about 12 cSt at 100° C.

17. The lubricating oil composition of claim 14 in combination with a viscosity index improving amount of said viscosity index improver.

18. The lubricating oil composition of claim 17 wherein said at least one $C_3$ to $C_{18}$ alphaolefin comprises propylene said viscosity index improver has a number average molecular weight of between about 20,000 and 500,000.

19. The lubricating oil composition of claim 18 wherein said viscosity index improver further includes greater than 0 to about 10 wt. % of a nonconjugated diene.

20. The lubricating oil composition of claim 14 wherein said dual additive composition is present in an amount comprising between about 0.005 and 0.7 wt. % thereof.

21. The lubricating oil composition of claim 14 wherein said dual additive composition is present in an amount comprising between about 0.02 and 0.5 wt. % thereof.

22. The lubricating oil composition of claim 14 wherein said first and second components are present in amounts such that the weight ratio of the amount of said f first component to the amount of said second component is from about 90:10 to about 60:40.

23. The lubricating oil composition of claim 18 wherein said viscosity index improver is present in an amount of between about 0.2 and 2.8 wt. % thereof.

24. The lubricating oil composition of claim 14 wherein for both said first and second components said unsaturated dicarboxy ester comprises dialkyl fumarate and said vinyl ester is vinyl acetate.

25. The lubricating oil composition of claim 24 wherein the average side chain carbon number of said first component is from about 11.5 to about 12.2 and the average side chain carbon number of said second component is from about 12.8 to about 14.0.

26. The lubricating oil composition of claim 14 wherein said first and/or said second component is a copolymer comprised of (a) esterified $C_4$ to $C_{10}$ mono-ethylenically unsaturated dicarboxylic acid or anhydride, wherein the carboxyl groups are located on vicinal carbons, and (b) at least one $C_6$ to $C_{46}$ alpha-monoolefin.

27. The lubricating oil composition of claim 26 wherein in said copolymer, said esterified dicarboxylic acid or anhydride is derived from maleic anhydride.

28. The lubricating oil composition of claim 14 wherein said first and/or said second component is a copolymer comprised of (a) esterified $C_4$ to $C_{10}$ mono-ethylenically unsaturated dicarboxylic acid or anhydride, wherein the carboxyl groups are located on vicinal carbons and (b) styrene.

29. The lubricating oil composition of claim 28 wherein said second copolymer is a styrene esterified maleic anhydride interpolymer.

30. A lubricating oil concentrate comprising lubricating oil, and a dual additive composition in an amount effective to improve, relative to the absence of one or more components of said dual additive composition, at least the low temperature flow properties of lubricating oil compositions derived from said concentrates, when said lubricating oil compositions comprise at least one lubricating oil basestock selected from the group consisting of lubricating oils of greater than or equal to 90 wt. % saturates and less than or equal to 0.03 wt. % sulfur and a viscosity index in the range of greater than or equal to 80 and less than 120 and at least one viscosity index improver selected from the group consisting of copolymers of ethylene and at least one $C_3$ to about $C_{18}$ alphaolefin, wherein the ethylene content of said ethylene containing copolymer is greater than about 30 wt. % to about 85 wt. %, wherein said dual additive composition comprises said first and second added lubricating oil flow improver components of claim 1.

31. The lubricating oil concentrate of claim 30 wherein said dual additive composition comprises from about 2 to about 90 wt. % of said lubricating oil concentrate.

32. The lubricating oil concentrate of claim 30 wherein for both said first and second components said unsaturated dicarboxy ester comprises dialkyl fumarate and said vinyl ester is vinyl acetate.

33. The lubricating oil concentrate of claim 32 in combination with a viscosity index improving amount of at least one viscosity index improver selected from the group consisting of copolymers of ethylene and at least one $C_3$ to about $C_{18}$ alphaolefin, wherein the ethylene content of said ethylene containing copolymer is greater than about 35 wt. % to about 75 wt. %.

34. The lubricating oil concentrate of claim 33 wherein said viscosity index improver further includes greater than 0 to about 10 wt. % of a nonconjugated diene.

35. The composition of claim 32 wherein the average side chain carbon number of said first component is from 11.0 to 12.4 and the average side chain carbon number of said second component is from 12.7 to 15.0.

36. A method for improving at least the low temperature flow properties of a lubricating oil composition wherein said composition comprises at least one lubricating oil basestock selected from the group consisting of lubricating oils containing greater than or equal to 90 wt. % saturates and less than or equal to 0.03 wt. % sulfur and having a viscosity index in the range of greater than or equal to 80 and less than 120 and at least one viscosity index improver selected from the group consisting of copolymers of ethylene and at least one $C_3$ to about $C_{18}$ alphaolefin, wherein the ethylene content of said ethylene containing copolymer is greater than about 35 wt. % to about 75 wt. %, which method comprises adding to said lubricating oil composition the first and second added lubricating oil flow improver components of claim 1.

37. The method of claim 36 wherein for both said first and second components said unsaturated dicarboxy ester comprises dialkyl fumarate and said vinyl ester is vinyl acetate.

38. The method of claim 36 wherein said dual additive composition is included in said lubricating oil composition in an amount comprising between about 0.005 and 0.7 wt. % thereof.

39. The method of claim 36 wherein said first and second components are present in amounts such that the weight ratio of the amount of said first component to the amount of said second component is from about 95:5 to about 40:60.

40. The method of claim 36 wherein said viscosity index improver further includes greater than 0 to about 10 wt. % of a nonconjugated diene.

* * * * *